US007308731B2

(12) United States Patent
Schubring et al.

(10) Patent No.: US 7,308,731 B2
(45) Date of Patent: Dec. 18, 2007

(54) DAMPENED SLIDE FOR AN ANTI-CHUCKING WEDGE ASSEMBLY

(75) Inventors: Gary L. Schubring, Chesterfield, MI (US); Jason A. Meyers, Utica, MI (US)

(73) Assignee: Newfrey LLC, Newark, DE (US)

( * ) Notice: Subject to any disclaimer, the term of this patent is extended or adjusted under 35 U.S.C. 154(b) by 324 days.

(21) Appl. No.: 10/893,857

(22) Filed: Jul. 16, 2004

(65) Prior Publication Data

US 2005/0253398 A1 Nov. 17, 2005

Related U.S. Application Data

(60) Provisional application No. 60/571,631, filed on May 14, 2004.

(51) Int. Cl.
*E05F 5/00* (2006.01)

(52) U.S. Cl. ..... 16/86 R; 292/1

(58) Field of Classification Search ..... 16/85, 16/86 R, 86 A, 86 B, 74; 248/188.4, 410, 248/411, 615, 157, 205.3; 296/207; 180/69.21, 180/89.17; 292/DIG. 14; 439/545, 549, 439/552, 557, 567
See application file for complete search history.

(56) References Cited

U.S. PATENT DOCUMENTS

| | | | | |
|---|---|---|---|---|
| 1,089,193 | A | 3/1914 | Ervien | |
| 1,884,998 | A | 10/1932 | Perry | |
| 3,140,517 | A | 7/1964 | Richter | |
| 4,192,039 | A | 3/1980 | Haberle et al. | |
| 4,261,612 | A | 4/1981 | Chrysler et al. | |
| 4,681,389 | A * | 7/1987 | Nakazawa et al. | 439/557 |
| 4,823,432 | A * | 4/1989 | Jan | 16/86 A |
| 4,867,599 | A * | 9/1989 | Sasajima | 403/338 |
| 4,924,549 | A * | 5/1990 | Morel et al. | 16/82 |
| 4,932,100 | A | 6/1990 | Flowers et al. | |
| 5,092,550 | A * | 3/1992 | Bettini | 248/188.4 |
| 5,193,961 | A * | 3/1993 | Hoyle et al. | 411/553 |
| 5,314,280 | A * | 5/1994 | Gagliardi et al. | 411/182 |
| 5,421,124 | A | 6/1995 | Zuccaro | |
| 5,549,351 | A | 8/1996 | Park | |
| 5,791,723 | A | 8/1998 | Bell et al. | |
| 5,802,671 | A | 9/1998 | Ikuma | |
| 5,820,394 | A * | 10/1998 | Kameyama et al. | 439/248 |
| 5,992,927 | A | 11/1999 | Scroggie | |
| 6,039,388 | A * | 3/2000 | Choi | 296/207 |
| 6,039,389 | A | 3/2000 | Monette et al. | |
| 6,088,878 | A * | 7/2000 | Antonucci et al. | 16/86 A |

(Continued)

FOREIGN PATENT DOCUMENTS

| | | |
|---|---|---|
| EP | 0540053 | 11/1992 |

(Continued)

OTHER PUBLICATIONS

International Search Report dated Aug. 17, 2006 (2 pgs).

*Primary Examiner*—Robert J. Sandy
(74) *Attorney, Agent, or Firm*—Harness, Dickey & Pierce, P.L.C.

(57) ABSTRACT

A dampened slide for a wedge assembly includes a slide housing having perimeter walls. First and second alignment members connect to the perimeter walls, each having a deflectable portion. The deflectable portions extend opposite to each other and transverse to a centerline of the housing.

28 Claims, 8 Drawing Sheets

U.S. PATENT DOCUMENTS 6,119,306 A * 9/2000 Antonucci et al. ..... 16/86 A
6,206,455 B1 3/2001 Faubert et al.
6,247,744 B1 6/2001 Townsend et al.
6,318,795 B1 11/2001 Pyo
6,349,989 B1 2/2002 Kim
6,507,976 B2 * 1/2003 Ichimaru ..... 16/82
6,676,201 B2 1/2004 Im et al.
6,752,642 B2 * 6/2004 Ushiro et al. ..... 439/248
6,857,166 B2 2/2005 Nakagaki et al.
7,014,258 B2 3/2006 Schubring
2003/0088940 A1 * 5/2003 Nakagaki et al. ..... 16/86 R
2005/0060867 A1 3/2005 Schubring et al.

FOREIGN PATENT DOCUMENTS

GB 274502 A 11/1927

* cited by examiner

DAMPENED SLIDE FOR AN ANTI-CHUCKING WEDGE ASSEMBLY

CROSS-REFERENCE TO RELATED APPLICATIONS

This application claims the benefit of U.S. Provisional Application No. 60/571,631, filed on May 14, 2004. The disclosure of the above application is incorporated herein by reference.

FIELD OF THE INVENTION

The present invention relates in general to displacement limiting systems and more specifically to a device and method of assembly for automobile door anti-chucking wedge assembly slides.

BACKGROUND OF THE INVENTION

Vehicles including automobile sport utility vehicles, station wagons, mini-vans, cross-over vehicles, cargo vans and trucks often provide an access door, commonly known as a lift-gate door. Other similar door designs include hatchback doors, sliding doors and horizontally swinging doors. Although these door designs can be mounted differently, for simplicity, these door designs will hereinafter be summarized in reference to lift-gate doors. Lift-gate doors are frequently hinged along an upper horizontal surface, and latch adjacent to a flooring system of the automobile, commonly adjacent to the rear fender of the automobile. One or more latches can be used. The side edges of lift-gate doors are generally not hinged or physically connected to the vehicle structure or support posts at the rear of the vehicle. Motion of the vehicle therefore can result in "match-boxing", or non-parallel deflection of the support posts relative to the squared sides of the lift-gate door. Match-boxing is undesirable for several reasons. First, side-to-side or non-parallel motion of support posts can impart additional vehicle noise, known as "chucking" at the lift-gate latch as the vehicle travels along rough or uneven surfaces. Second, unless a mechanism is positioned between the lift-gate door edge and the support posts of the vehicle, full structural allowance for the stiffness of the lift-gate cannot be used in the design of the support structure area.

In order to include the stiffness of the lift-gate door in the analysis and design of structural support posts, wedge assemblies having movable slides have been used which displace to span the gap between the lift-gate door and the support post. These assemblies reduce match-box deflection of the support posts by transferring some deflection load to the lift-gate door using wedge assemblies generally positioned between each support post and the lift-gate door. The wedge assembly can be fastened to either or both edges of the lift-gate door or to an edge of one or both of the support posts. In a further known design, a slide assembly is positioned against each lift-gate door side edge and a striker plate is separately mounted to each support post such that the slide engages the striker plate to limit match-boxing of the support posts.

Common designs for wedge assemblies have several problems. First, vehicle rattling noise is produced if the slide is not maintained in continuous contact with the striker plate (or vehicle support post) throughout the travel length of the slide. Tolerances used for common wedge assembly slides permit easy translation, but can result in rattling between the parts during vehicle travel. Second, vehicle manufacturing tolerances can result in positions of non-contact between the slide and the striker plate (or vehicle support post). If the slide is not maintained in contact with the vehicle support post or striker plate, rattling can occur. Third, contaminants such as dirt which contact portions of the wedge assembly can prevent the slide from moving freely, thus resulting in increased chucking or rattling noise.

SUMMARY OF THE INVENTION

According to a preferred embodiment, a dampened slide for a wedge assembly of the present invention includes a slide housing defining perimeter walls. First and second alignment members connect to the perimeter walls, each having a deflectable portion. The deflectable portions extend opposite to each other and transverse to a centerline of the slide housing.

According to another aspect of the present invention, an anti-chucking door wedge assembly includes a contact surface integrally connecting the first and second perimeter walls. A support plate includes substantially parallel first and second raised channels. The first alignment member is received within the first raised channel and the second alignment member is slidably received within the second raised channel.

According to yet another aspect of the present invention, a method is provided for creating an anti-chucking wedge assembly. The method includes: integrally connecting the support plate to the wedge body; creating an engagement surface on the wedge body substantially bounded between the raised channels; biasing the deflectable members in each of two directions; and slidably engaging the deflectable members of the slide housing with the raised channels such that the slide housing slidably engages the engagement surface.

A dampened slide for a wedge assembly of the present invention provides several advantages. By providing deflectable members integrally connected to a slide housing which bias upon engagement within raised channels of the wedge body, the slide is biased into contact with the raised channels to reduce rattling of the slide. By providing deflectable members capable of deflecting in at least two directions, rattling is further reduced. Tabs are extended from the deflectable members which engage with shoulders created in the slide housing to limit deflection and prevent locking of the slide in a fully extended position. Non-deflecting portions are provided with the deflectable members to assist the deflectable members to fully engage with the raised channels.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
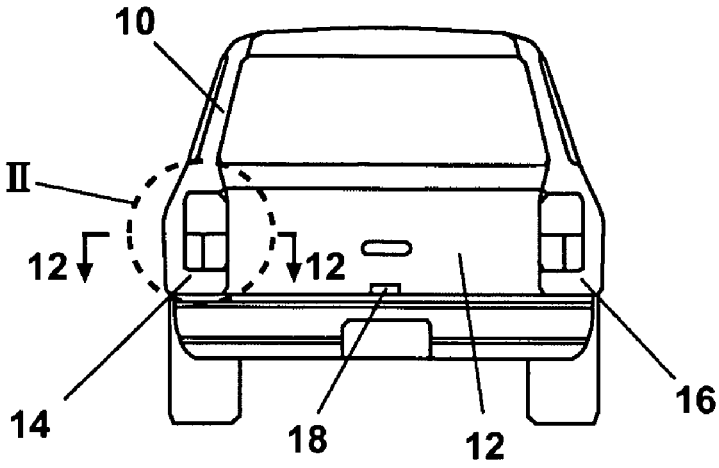
FIG. 1 is a rear elevational view of an automobile incorporating wedge assemblies of the present invention.

As shown in FIG. 1, a vehicle 10 includes a rear lift-gate door 12 positioned adjacent a left support post 14 and a right support post 16 of vehicle 10. A latch 18 is generally provided about mid span along a bottom edge of rear lift-gate door 12. Side edges of rear lift-gate door 12 adjacent to left support post 14 and right support post 16, respectively, are generally not latched or otherwise connectable to left support post 14 or right support post 16. For simplicity, discussion of the present invention refers in general to devices connected to left support post 14. Assemblies of the present invention are not limited to specific locations, and can be connected to right support post 16 or other component parts of vehicle 10.

Figure 2:
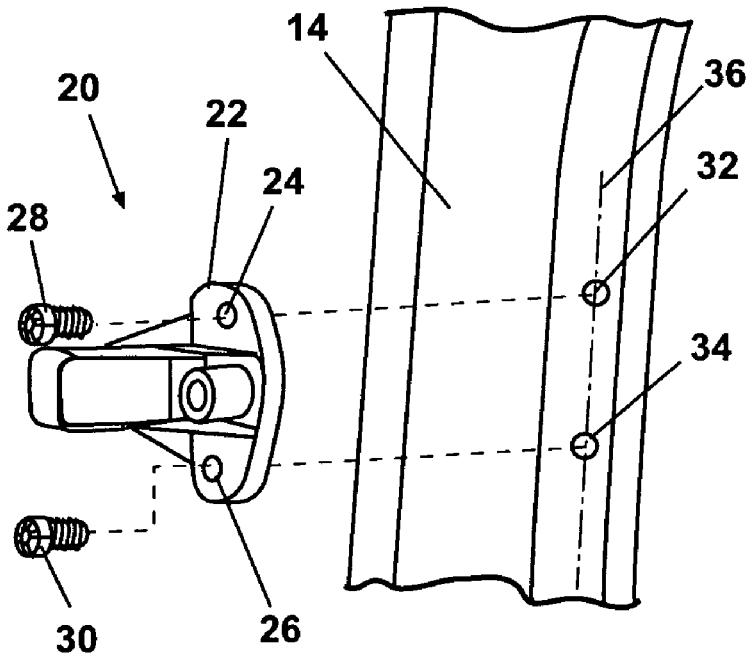
FIG. 2 is a fragmentary perspective view taken from area 11 of FIG. 1.

As best seen in FIG. 2, a striker 20 having a striker body 22 is supported from left support post 14. Striker body 22 includes a first clearance aperture 24 and a second clearance aperture 26. Fasteners 28 and 30 are inserted through each of first clearance aperture 24 and second clearance aperture 26, respectively, to fastenably engage with a first engagement aperture 32 and a second engagement aperture 34, respectively, provided in left support post 14. First engagement aperture 32 and second engagement aperture 34 are commonly aligned on an aperture centerline 36.

Figure 3:
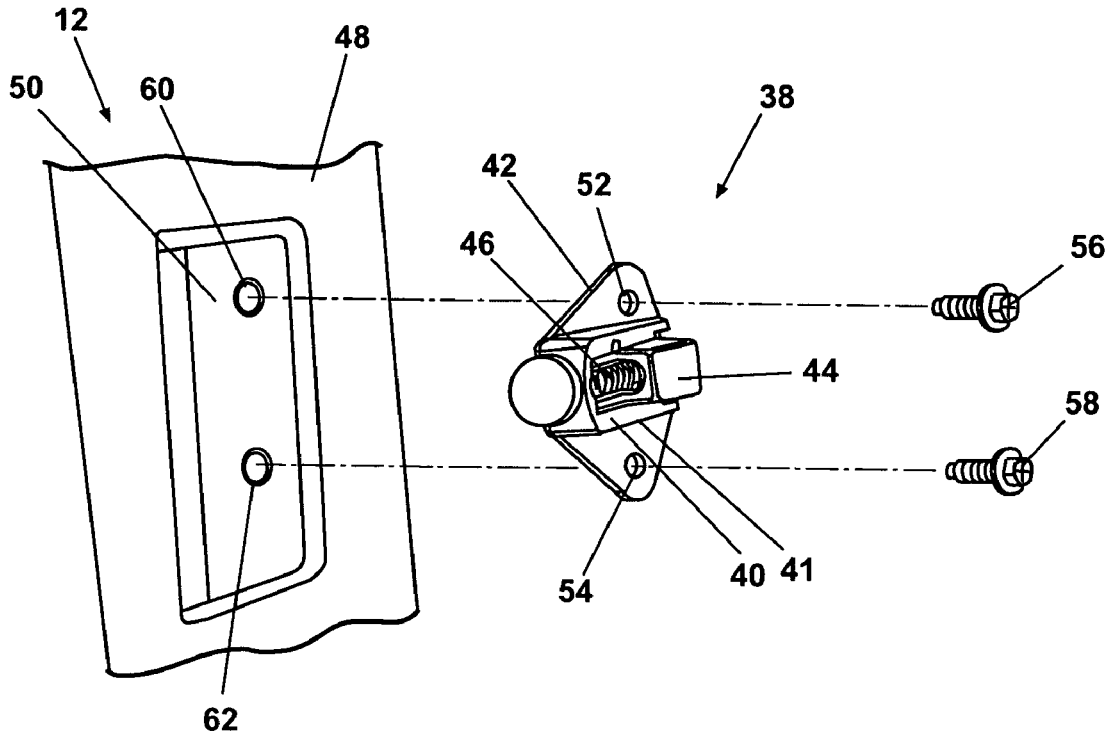
FIG. 3 is a fragmentary perspective view showing a sliding wedge assembly taken from area 11 of FIG. 1.

Referring generally to FIG. 3, wedge assembly 38 includes an engagement surface 40 operably created on a wedge body 41. Wedge body 41 is integrally connected to a support plate 42. A slide 44 is slidably disposed on engagement surface 40 and is retained by a biasing device 46. Engagement surface 40 is created as an inclined surface with respect to support plate 42. Biasing device 46 can be a spring or similar device, which is preferably made of spring steel. Wedge assembly 38 is fastenably connected to a support surface 48 of rear lift-gate door 12 within a recessed area 50 created within support surface 48. Support plate 42 includes a first clearance aperture 52 and a second clearance aperture 54. A first fastener 56 and a second fastener 58 are inserted through first clearance aperture 52 and second clearance aperture 54, respectively, to fastenably engage within a first engagement aperture 60 and a second engagement aperture 62, respectively, created in recessed area 50.

Figure 4:
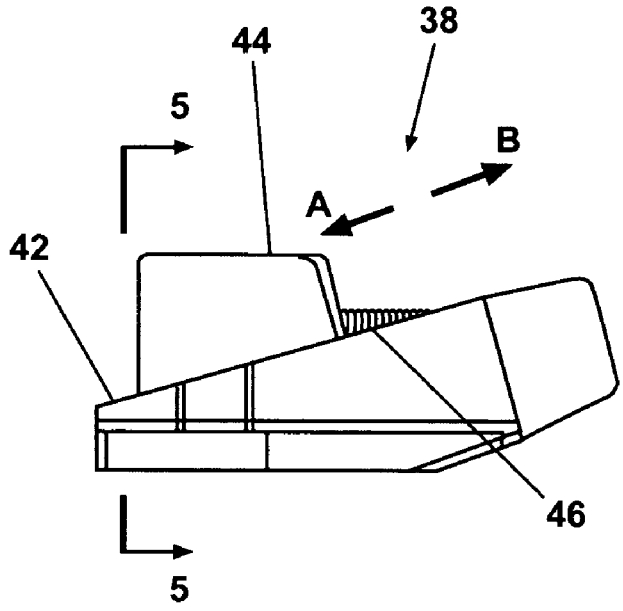
FIG. 4 is a side elevational view of the wedge assembly of FIG. 3.
Figure 5:
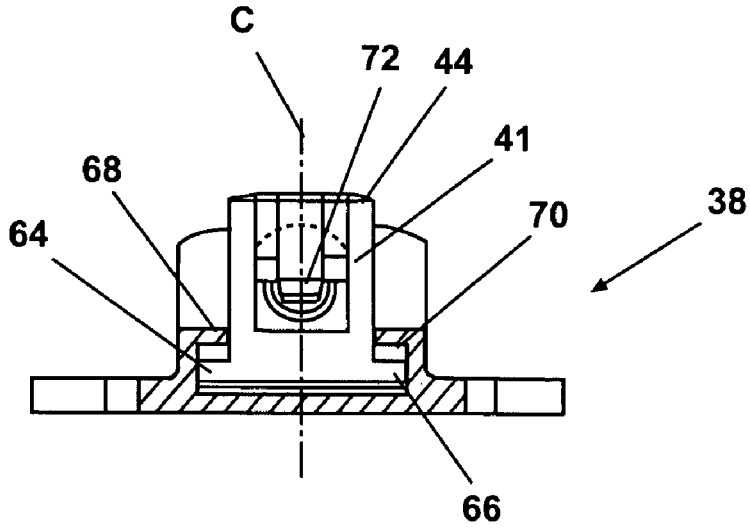
FIG. 5 is a cross sectional end elevational view taken at section 5-5 of FIG. 4.

Referring generally to FIGS. 4 and 5, slide 44 moves (by a sliding motion) substantially parallel to engagement surface 40 in each of a displacement direction "A" and "B". When slide 44 slides in the displacement direction "A", biasing device 46 biases slide 44 to return to a normal or non-biased position by retracting slide 44 in displacement direction "B". Slide 44 includes a first alignment member 64 and a second alignment member 66, each extending substantially transverse to a centerline "C" of slide 44. First alignment member 64 is slidably retained within a first raised channel 68 created in support plate 42. Second alignment member 66 is similarly slidably retained within a second raised channel 70 created in support plate 42. First and second raised channels 68, 70 are positioned substantially parallel to each other. Engagement surface 40 is substantially bounded between first and second raised channels 68, 70. Engagement surface 40 can also include a plurality of raised ribs operable to create a textured surface for engagement surface 40. Slide 44 defines a slide housing 71 having a retaining member 72 integrally connected to slide housing 71. Retaining member 72 supports a first end of biasing device 46. A second end of biasing device 46 is connected to wedge body 41.

Figure 6:
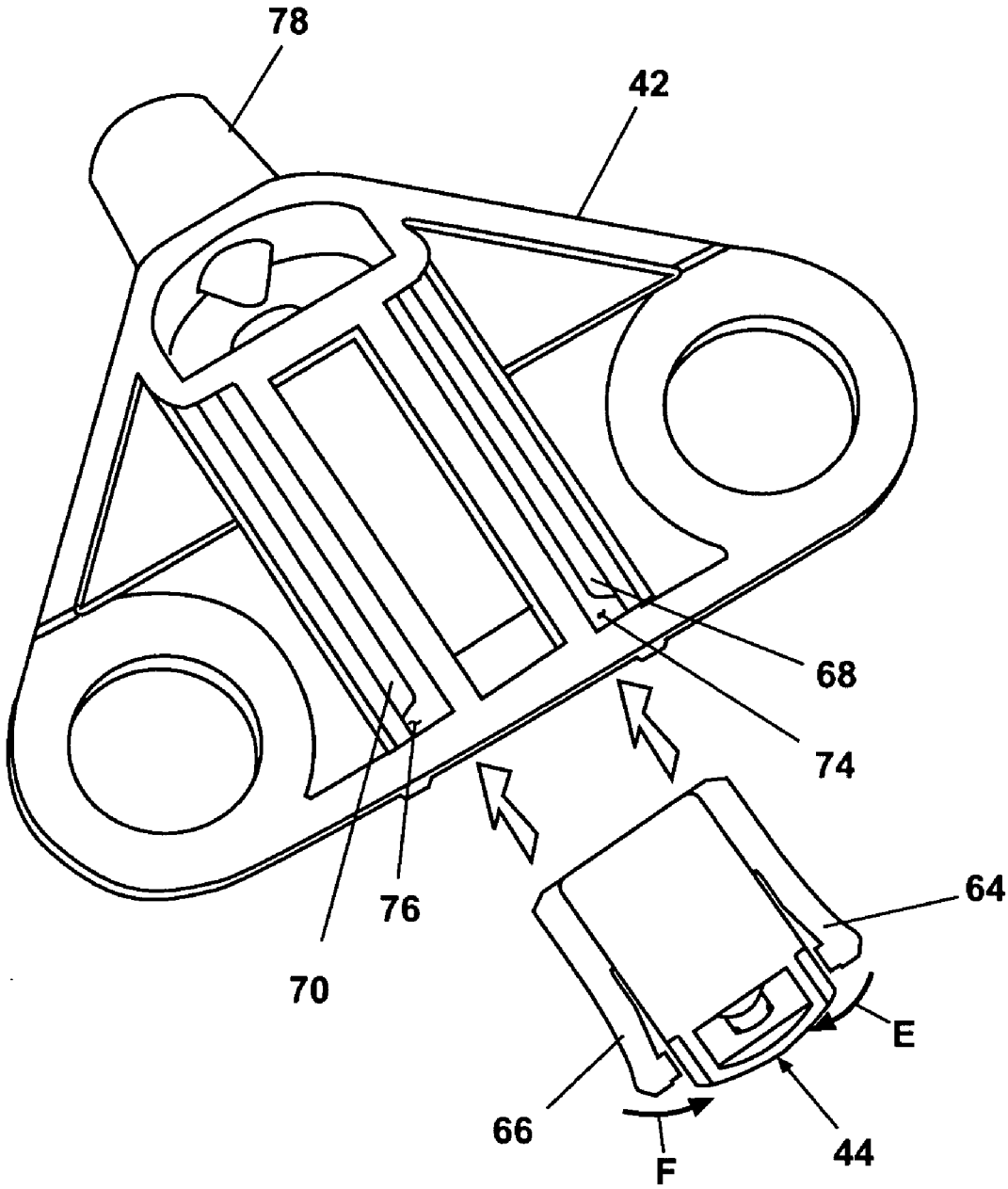
FIG. 6 is a bottom perspective view of the wedge assembly of FIG. 3.

As best seen in FIG. 6, first raised channel 68 and second raised channel 70 extend from support plate 42 (away from the viewer as viewed in FIG. 6). A pair of tooling apertures 74 and 76 are created at distal ends of each of first raised channel 68 and second raised channel 70 to permit support plate 42 to be created in a molding operation. Slide 44 is slidably engaged with support plate 42 in an insertion direction "D" by inserting first alignment member 64 and second alignment member 66 into respective ones of first raised channel 68 and second raised channel 70. First alignment member 64 deflects in the direction of arc "E" and second alignment member 66 deflects in the direction of arc "F" upon insertion into the first and second raised channels 68, 70. A bumper 78 is also connected to support plate 42, opposite to the insertion point of slide 44.

Figure 7:
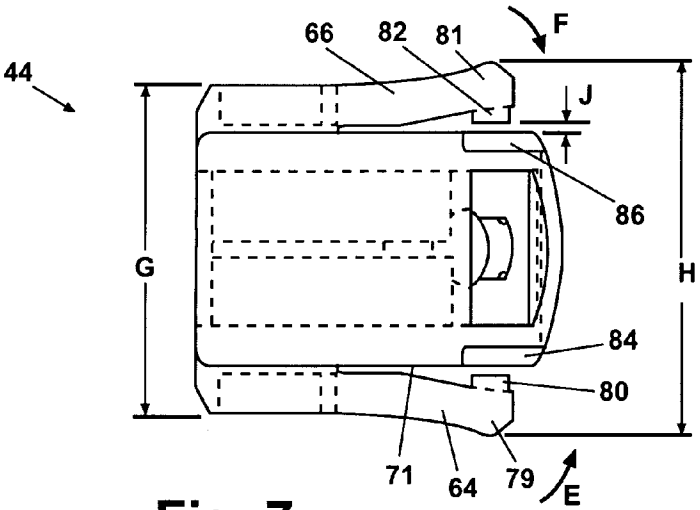
FIG. 7 is a plan view of a slide of the present invention.

Referring now in general to FIG. 7, a fixed width "G" is provided across both first alignment member 64 and second alignment member 66 of slide 44. A maximum non-deflected width "H" is measurable across distal non-supported ends of first alignment member 64 and second alignment member 66. As clearly seen in FIG. 7, first alignment member 64 and second alignment member 66 can each deflect from maximum non-deflected width "H" about arcs "E" and "F" respectively. First alignment member 64 includes a deflectable portion 79 having a first tab 80 extending transverse thereto, and second alignment member 66 includes a deflectable portion 81 having a second tab 82 extending transverse thereto. When first alignment member 64 and second alignment member 66 slidably engage within first and second raised channels 68, 70, the distal end of each alignment member deflects about a deflection arc "Q". Deflection about deflection arc "Q" is limited by first tab 80 engaging a first shoulder 84, and second tab 82 engaging a second shoulder 86. Both first and second shoulders 84, 86 are created as recessed portions of slide housing 71. By limiting their deflection using first and second tabs 80, 82, first alignment member 64 and second alignment member 66 are prevented from locking within tooling apertures 74 and 76. If locking occurs, biasing device 46 cannot bias slide 44 in displacement direction "B" and rattling noise or locking of wedge assembly 38 can occur. A clearance "J" is provided in the non-deflected condition of both first and second alignment members 64, 66 between each of first and second tabs 80, 82 and the outside walls of slide housing 71.

Figure 8:
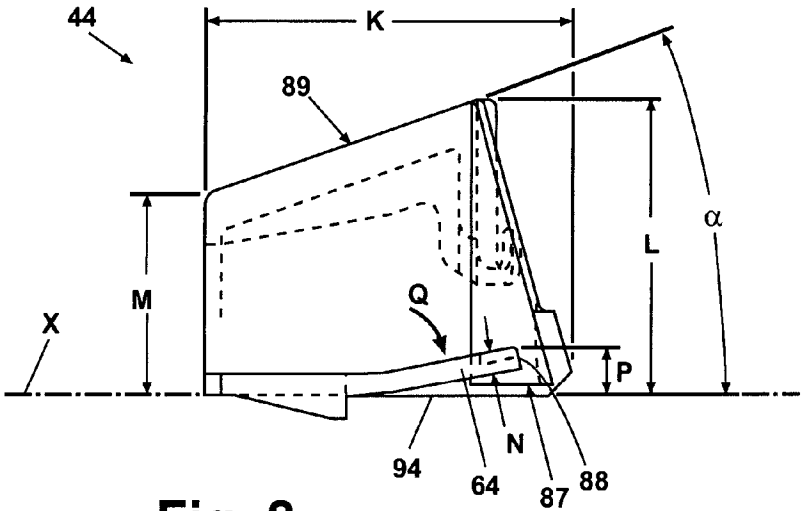
FIG. 8 is a side elevational view of the slide of FIG. 7.
Figure 9:
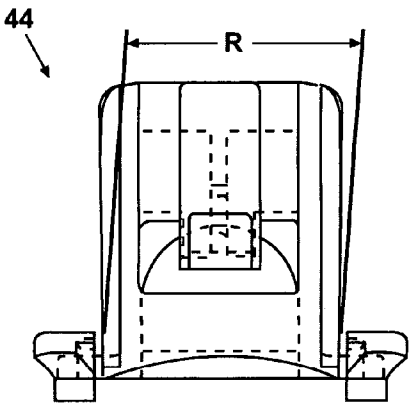
FIG. 9 is an end elevational view of the slide of FIG. 7.

As best seen in FIGS. 8 and 9, slide 44 further includes a total length "K", a major height "L" and a minor height "M".

A contact surface 89 is created at an inclination angle α from a plane "X" located opposite to contact surface 89. Inclination angle α is operably created by a height difference between major height "L" and minor height "M". A first engagement surface 94 is defined parallel to plane "X" (a second engagement surface 96 is shown in reference to FIG. 11). Each of first and second alignment members 64, 66 include a thickness "N" and a distal end 88 provided at a non-deflected height "P". Both first and second alignment members 64, 66 can deflect along a deflection arc "Q" from the non-deflected height "P" when engaged within first and second raised channels 68, 70. A housing width "R" is also provided. Displacement of each of first and second alignment members 64, 66 are limited along a deflection path of arc "Q" by a tab engagement surface 87 provided for each of first and second shoulders 84, 86. First and second tabs 80, 82 deflect inwardly about arcs "E" and "F" and contact tab engagement surfaces 87 preventing continued deflection of first and second alignment members 64, 66.

In one aspect of the present invention, slide 44 includes dimensions as follows: fixed width "G" is approximately 21 mm; maximum non-deflected width "H" is approximately 23.8 mm; clearance "J" is approximately 0.5 mm; total length "K" is approximately 23.54 mm; major height "L" is approximately 18.8 mm; minor height "M" is approximately 12.8 mm; thickness "N" is approximately 1.4 mm; non-deflected height "P" is approximately 3.0 mm; and housing width "R" is approximately 15.0 mm. Material for slide 44, wedge body 41 and support plate 42 is preferably a polymeric material, including, but not limited to acetal and nylon. Wedge body 41 and support plate 42 are preferably formed in a co-molding process of at least one polymeric material. Slide 44 is preferably a molded polymeric part formed in a separate molding operation from wedge body 41 and support plate 42.

Figure 10:
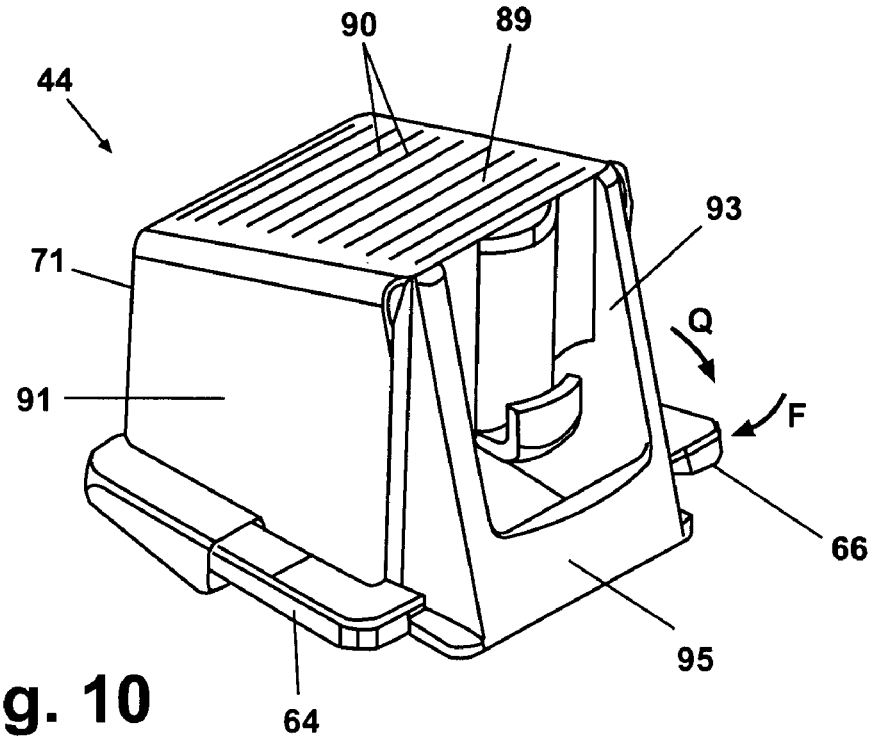
FIG. 10 is a perspective view of the slide of FIG. 7.
Figure 11:
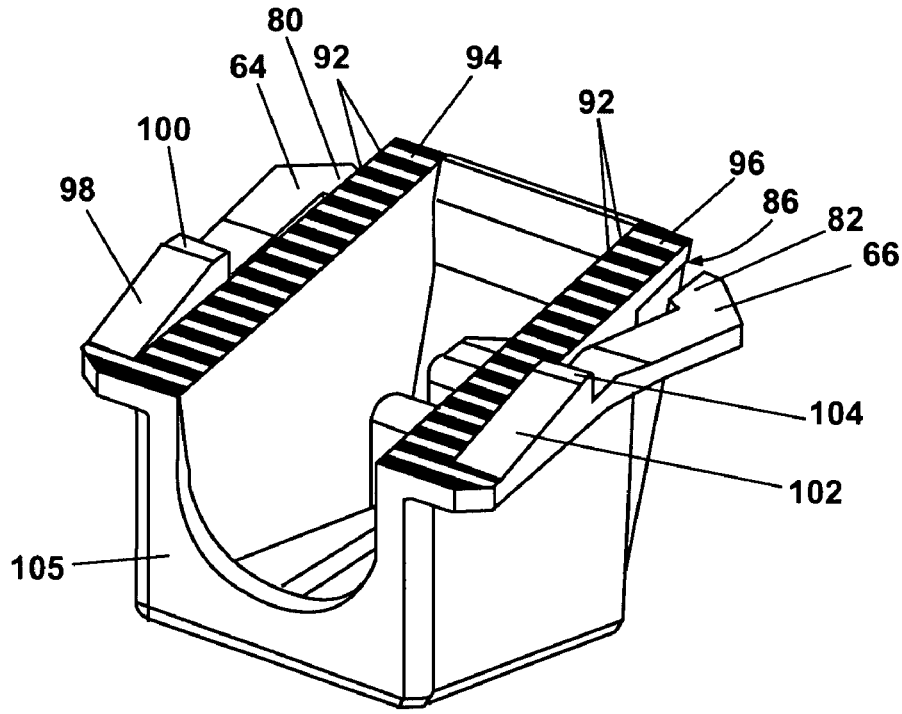
FIG. 11 is a rotated bottom perspective view of the slide of FIG. 10.

Referring generally to FIGS. 10 and 11, slide 44 preferably provides a plurality of raised ribs 90 on contact surface 89. A similar plurality of raised ribs 92 is provided on each of first engagement surface 94 and second engagement surface 96 of slide housing 71. First alignment member 64 is integrally connected at one end to a first perimeter wall 91. First alignment member 64 further includes a non-deflecting portion 98 having a flat engagement surface 100. Second alignment member 66 is integrally connected at one end to a second perimeter wall 93. Second alignment member 66 also includes a non-deflecting portion 102 having a flat engagement surface 104. Slide housing 71 also includes a major height wall 95 positioned adjacent retaining member 72 and a minor height wall 105 positioned opposite to major height wall 95.

Flat engagement surfaces 100 and 104 engage surfaces of first and second raised channels 68, 70 opposite to those engaged by distal ends 88 of each of first and second alignment members 64, 66. Each of non-deflecting portions 98 and 102 extend transverse to plane "X" and opposite to contact surface 89. Slide 44 therefore provides at least two dimensions of biased engagement (for example deflection arc "Q" and arc "F") between each of first and second alignment members 64, 66 within first and second raised channels 68, 70 to reduce rattling or chucking of wedge assembly 38. By selective use of material for slide 44 including a preferred acetal material, creep of first and second alignment members 64, 66 over extended time periods is reduced and biasing force is maintained.

Figure 12:
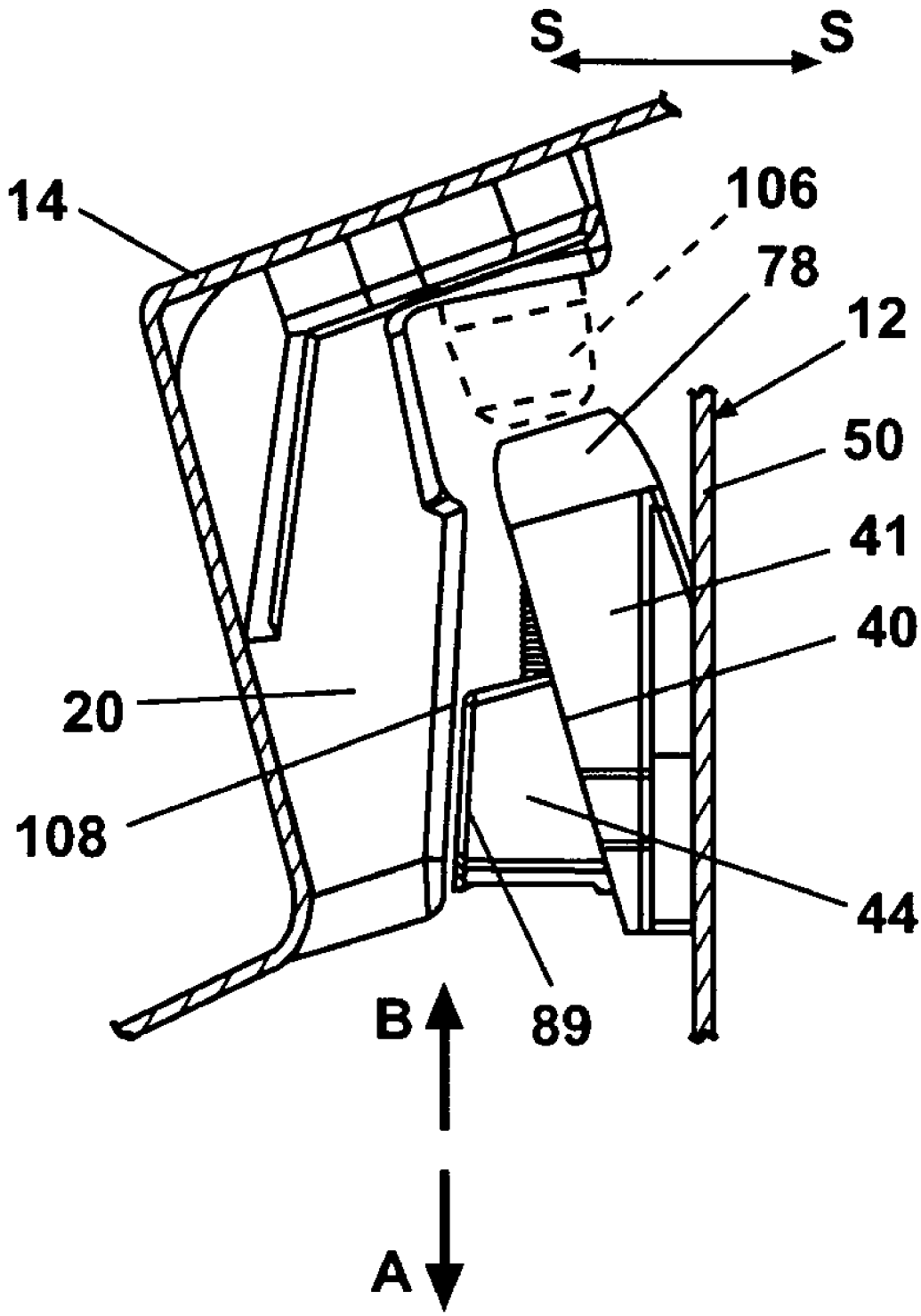
FIG. 12 is a cross sectional view taken at section 12-12 of FIG. 1.

Referring generally to FIG. 12, in an exemplary installed condition of striker 20 and wedge assembly 38, vehicle 10 cross car displacement "S" between rear lift-gate door 12 and left support post 14 is compensated by displacement of slide 44 in displacement direction "A" or "B". Front-to-back door displacement is limited by engagement of bumper 78 with striker 20 and/or by latch 18. Contact surface 89 slidably engages a striker engagement surface 108. In another aspect, bumper 78 is eliminated and replaced with a bumper 106 (shown in phantom) connected to striker 20.

Figure 13:
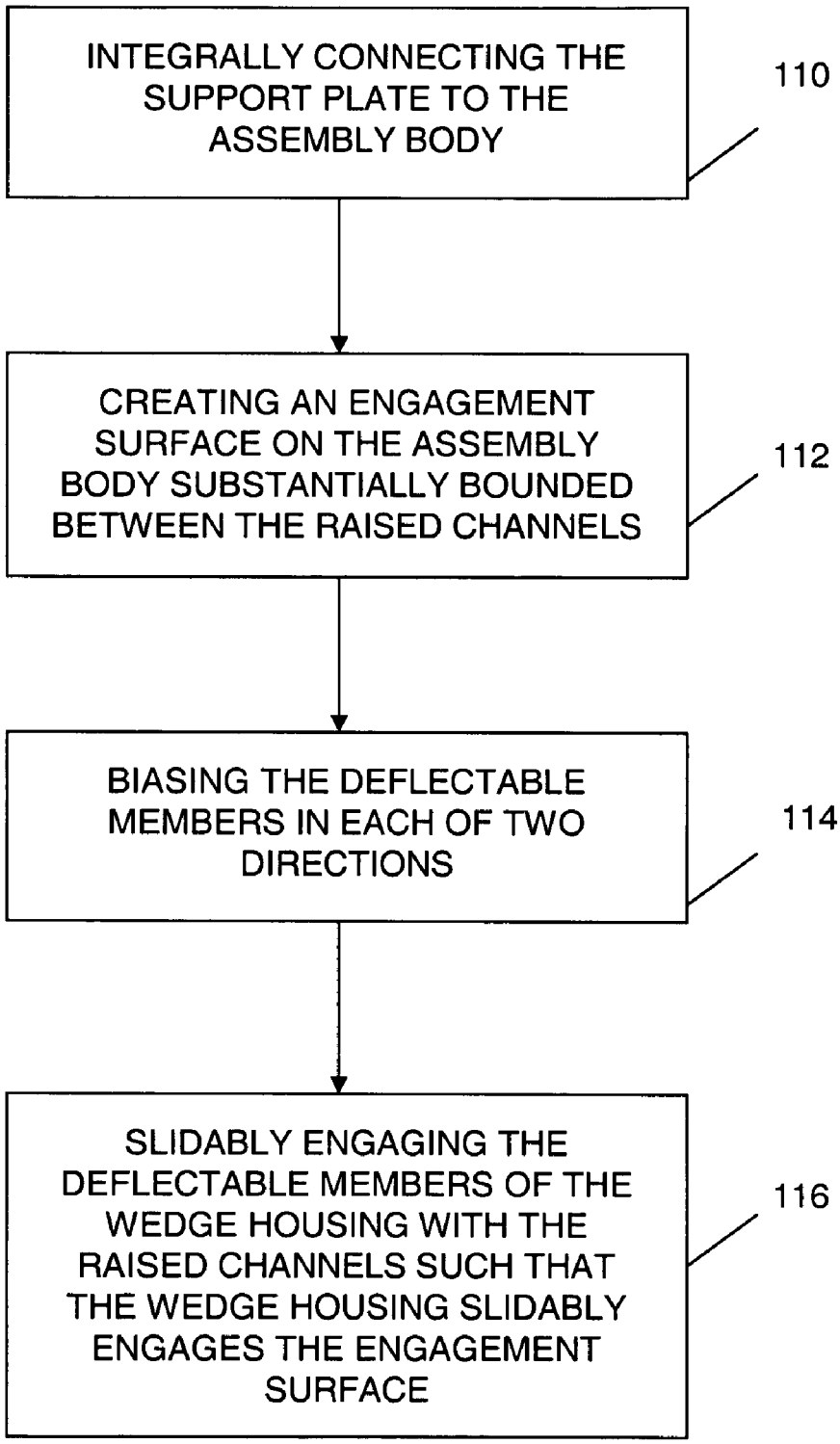
FIG. 13 is a flow diagram of a method for creating a dampened slide wedge assembly of the present invention.

Referring finally to FIG. 13, in a step 110 the support plate is integrally connected to the wedge body. In a next step 112, an engagement surface is created on the wedge body substantially bounded between the raised channels. In a following step 114, the deflectable members are biased to deflect in each of two directions. In a step 116, the deflectable members of the wedge housing are engaged with the raised channels such that the wedge housing slidably engages the engagement surface.

In another aspect of the present invention, wedge assembly 38 is fastenably connected to left support post 14 and/or right support post 16 of vehicle 10 in lieu of to rear lift-gate door 12. In further aspects of the present invention, strikers 20 are eliminated or replaced with raised embossments positioned on left support post 14 and/or right support post 16. Strikers 20 can also be replaced with a low friction pad such as a nylon pad or a high or ultra high molecular weight polymeric material.

A dampened slide for a wedge assembly of the present invention provides several advantages. Noise that could be created by rattling of assembly members is dampened by biasing the wedge into engagement with the raised channels. Deflectable members of the slide housing bias upon engagement within raised channels. The deflectable members are capable of deflecting in at least two directions to fully engage the raised channels. Tabs extending from the deflectable members engage with shoulders created in the slide housing to limit deflection and prevent locking of the slide in a fully extended position. Non-deflecting portions of the deflectable members are provided to help the deflectable members to fully engage the raised channels.

The description of the invention is merely exemplary in nature and, thus, variations that do not depart from the gist of the invention are intended to be within the scope of the invention. Such variations are not to be regarded as a departure from the spirit and scope of the invention. Dampened slides for anti-chucking wedge assemblies of the present invention are described herein relative to applications between vehicle support posts and rear lift-gate doors. The invention is not limited to applications between these components, but can be used in any application where relative motion between component parts of a vehicle can benefit from the use of dampened slides for wedge assemblies of the present invention. These applications include, but are not limited to: between sliding doors and sliding door surrounding support structure, between cargo doors and surrounding vehicle structure, between side or horizontally opening doors and vehicle structure, between tailgates and vehicle support structure, between multiple opening panels of a vehicle and vehicle support structure, between cockpit doors and surrounding aircraft structure, or between tractor doors and surrounding structure, etc. The deflectable alignment members can also be modified, for example to be fixed to the slide housing at opposed ends and free to deflect in a central portion of the members. In another aspect, the shoulders 84, 86 recessed into the slide housing 71 which receive the tabs 80, 82 can be eliminated and replaced with male extending members which engage the alignment members, allowing the tabs to be eliminated.

What is claimed is:

1. An automobile vehicle anti-chucking wedge assembly slide, comprising:

a slide housing defining at least a first and a second perimeter wall, the second perimeter wall opposing the first perimeter wall, and a contact surface integrally connecting the first and second perimeter walls;

a first alignment member connectable to the first perimeter wall, the first alignment member defining a first deflectable portion deflectable about a first arc toward the first alignment wall and about a second arc substantially perpendicular to the first arc; and a second alignment member connectable to the second perimeter wall, the second alignment member defining a second deflectable portion deflectable about a third arc toward the second alignment wall and about the second arc substantially perpendicular to the third arc;

wherein the first and the second deflectable portions each extend opposite to each other and transverse to a centerline of the slide housing in a non-deflected state.

2. The slide of claim 1, further comprising a tab integrally connectable adjacent a distal end of each of the first and second alignment members.

3. The slide of claim 1, further comprising a plurality of raised ribs disposed on the contact surface.

4. The side of claim 1, wherein each of the first and second alignment members further comprise a non-deflecting portion.

5. The slide of claim 4, wherein each non-deflecting portion further comprises a flat engagement surface.

6. The side of claim 1, further comprising a biasing device retaining member.

7. The slide of claim 1, further comprising:

an engagement surface of the slide positionable opposite to the contact surface; and wherein each of the first and second alignment members defines a non-deflected height measurable from a plane parallel to the engagement surface.

8. The slide of claim 7, wherein each of the first and second alignment members further comprise a non-deflecting portion extending transverse to the plane and opposite to the contact surface.

9. An automobile vehicle anti-chucking wedge assembly slide, comprising:

a slide housing defining at least a first and a second perimeter wall, the second perimeter wall opposing the first perimeter wall, and a contact surface integrally connecting the first and second perimeter walls;

a first alignment member connectable to the first perimeter wall, the first alignment member defining a first deflectable portion;

a second alignment member connectable to the second perimeter wall, the second alignment member defining a second deflectable portion;

a major height wall operably connecting the first and second perimeter walls; and a minor height wall opposed to the major height wall operably connecting the first and second perimeter walls;

wherein an inclination angle is operably created for the contact surface by a difference in height between the major height wall and the minor height wall, and wherein the first and the second deflectable portions each extend opposite to each other and transverse to a centerline of the slide housing.

10. An automobile vehicle anti-chucking wedge assembly slide, comprising:

a slide housing defining four perimeter walls, including opposed first and second perimeter walls, and opposed third and fourth perimeter walls, the third perimeter wall having a height greater than a fourth perimeter wall height, and a contact surface integrally connecting the first and second perimeter walls;

a first alignment member connectable to the first perimeter wall, the first alignment member defining a first deflectable portion;

a second alignment member connectable to the second perimeter wall, the second alignment member defining a second deflectable portion;

a tab integrally connectable adjacent a distal end of each of the first and second alignment members;

a first shoulder created in the first perimeter wall operable to receive the tab of the first alignment member; and a second shoulder created in the second perimeter wall operable to receive the tab of the second alignment member;

wherein the first and the second deflectable portions each extend opposite to each other and transverse to a centerline of the slide housing.

11. An anti-chucking door wedge assembly, comprising:

a slide housing defining at least a first and a second perimeter wall, the second perimeter wall opposing the first perimeter wall, and a contact surface integrally connecting the first and second perimeter walls;

a first alignment member connectable to the first perimeter wall, the first alignment member defining a first deflectable portion;

a second alignment member connectable to the second perimeter wall, the second alignment member defining a second deflectable portion; and a support plate including substantially parallel first and second raised channels;

wherein the first alignment member is slidably received within the first raised channel operably biasing the first deflectable portion, and the second alignment member is slidably received within the second raised channel operably biasing the second deflectable portion.

12. The system of claim 11, further comprising a striker positionable to slidably engage the contact surface.

13. The system of claim 11, further comprising a bumper connectable to the slide.

14. The system of claim 11, further comprising a biasing device movably connecting the slide housing to the support plate.

15. The system of claim 11, wherein each of the first and second deflectable portions further comprise a tab.

16. The system of claim 15, wherein the slide housing further comprises a first and a second shoulder, the first shoulder operable to engage the tab of the first deflectable portion and the second shoulder operable to engage the tab of the second deflectable portion.

17. The system of claim 16, further comprising a tooling aperture created in each of the first and second raised channels, wherein engagement of the tab of each of the first and second deflectable portions with one of the first and second shoulders prevents engagement of the first and second alignment members with the tooling apertures.

18. The system of claim 11, wherein the contact surface further comprises a plurality of raised ribs.

19. The system of claim 11, wherein each of the first and second alignment members are deflectable along each of a first and a second arc.

20. An automobile vehicle anti-chucking wedge assembly slide, comprising:

a slide housing having opposing first and second perimeter walls, and opposed third and fourth perimeter walls, the third perimeter wall having a height greater than a fourth perimeter wall height;

a first alignment member connectable to the first perimeter wall, the first alignment member defining a first deflectable portion; and a second alignment member connectable to the second perimeter wall, the second alignment member defining a second deflectable portion;

a tab integrally connectable adjacent a distal end of each of the first and second alignment members; and a cavity created in each of the first and second perimeter walls operable to receive the tab of the first and second alignment members, respectively.

21. The slide of claim 20, wherein the first and the second deflectable portions each extend opposite to each other and transverse to a centerline of the slide housing.

22. The slide of claim 20, further comprising a contact surface integrally connecting the first and second perimeter walls.

23. A method for creating an anti-chucking wedge assembly, the wedge assembly including at least a slide housing having a pair of opposed perimeter walls and a deflectable member connected to each of the opposed perimeter walls, a support plate having substantially parallel raised channels, and an wedge body, the method comprising:

integrally connecting the support plate to the wedge body;

creating an engagement surface on the wedge body substantially bounded between the raised channels;

biasing the deflectable members in each of a first and a second direction; and slidably engaging the deflectable members of the wedge housing with the raised channels such that the slide housing slidably engages the engagement surface.

24. The method of claim 23, comprising:

creating an inclined contact surface on the slide housing;

configuring the engagement surface as an inclined surface.

25. The method of claim 24, comprising creating a plurality of raised ribs on both the contact surface and the engagement surface where the contact surface operably engages the engagement surface.

26. The method of claim 23, comprising connecting the slide housing to the wedge body using a biasing device.

27. The method of claim 23, comprising:

creating opposed shoulders in the slide housing; and extending a tab from each of the deflectable members operable to engage one of the opposed shoulders.

28. The method of claim 27, comprising positioning each shoulder along an arc path of one of the deflectable members to operably limit a deflection of each deflectable member.

* * * * *